US005379477A

United States Patent [19]

Tamai et al.

[11] Patent Number: 5,379,477

[45] Date of Patent: Jan. 10, 1995

[54] COATING FILM TRANSFER TOOL

[75] Inventors: Shigeru Tamai, Ikeda, Japan; Naomi Ikeda, London, United Kingdom; Kakuhei Koyama, Osaka, Japan

[73] Assignee: Seed Rubber Company, Ltd., Osaka, Japan

[21] Appl. No.: 39,172

[22] PCT Filed: Aug. 28, 1992

[86] PCT No.: PCT/JP92/01098

§ 371 Date: Apr. 15, 1993

§ 102(e) Date: Apr. 15, 1993

[87] PCT Pub. No.: WO93/04875

PCT Pub. Date: Mar. 18, 1993

[30] Foreign Application Priority Data

Aug. 30, 1991 [JP] Japan ..... 3-246848

[51] Int. Cl.[6] ..... B05C 1/14

[52] U.S. Cl. ..... 15/104.94; 15/97.1; 118/257

[58] Field of Search ..... 15/104.94, 3.53, 3; 118/257; 400/695, 696

[56] References Cited

U.S. PATENT DOCUMENTS 4,112,536 9/1978 Carson, Jr. et al. ..... 15/104.94

FOREIGN PATENT DOCUMENTS 3834374 4/1990 Germany ..... 118/257

63-56690 4/1988 Japan .

*Primary Examiner*—Edward L. Roberts

*Attorney, Agent, or Firm*—Armstrong, Westerman, Hattori, McLeland & Naughton

[57] ABSTRACT

A coating film transfer tool is disclosed, wherein a case 31 provides therein a pay-out reel 34 for feeding a coating a film transfer tape and a winding reel 35 for recovering a used coating film transfer tape free to rotate, a peak-shaped paint film transfer head 36 is protrusively provided at one end of the case 31, the pay-out reel 34 is made by setting a pay-out cylinder 42 on the outer periphery of the boss 40 of the drive gear wheel 39 via a friction member 41 made of an elastomer free to rotate, the winding reel 35 is made by providing a driven gear wheel 50 engaging with the drive gear wheel 39 on the outer periphery of the winding cylinder 48 and one end of the coating film transfer tape 38 wound on the pay-out cylinder 42 is fed from the pay-out cylinder 42 and then turned back by the peak-shaped portion 51 of the head 36 and is then wound by the winding cylinder 48. When, as erasing is continued, the synchronism between the feeding speed and the winding speed of the coating film transfer tape 38 has been broken, the pay-out cylinder 42 slips against the boss 40 of the drive gear wheel 39 via the friction member 41 to thereby restore synchronism between the above-mentioned two speeds. Smooth running of the coating film transfer tape is thus ensured.

6 Claims, 3 Drawing Sheets

Fig.4
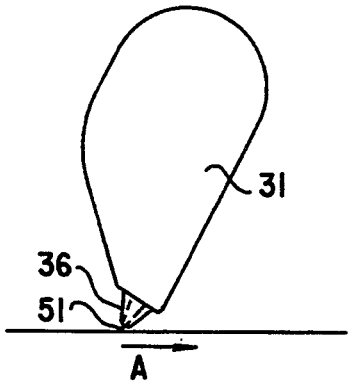
Fig.5
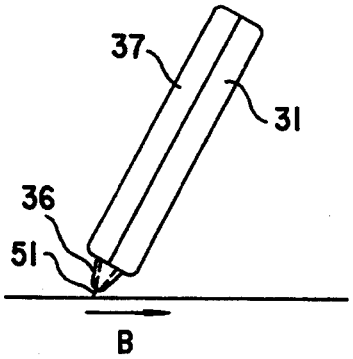
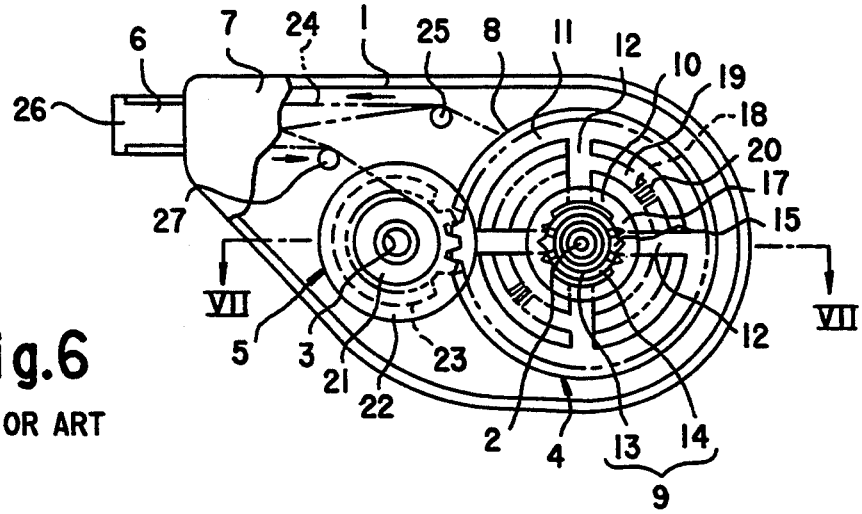
Fig.6
PRIOR ART

COATING FILM TRANSFER TOOL

TECHNICAL FIELD

The present invention relates to a coating film transfer tool with which it is possible to recover the used coating film transfer tape automatically.

BACKGROUND ART

As an example of this kind of a coating film transfer tool, Japanese Patent Publication No. 11639/1991 has hitherto been widely known. The tool disclosed in the aforementioned patent publication is made up of a pay-out reel with a coating film transfer tape wound thereon and a winding reel for recovering the used tape disposed in a case and a peak-shaped head for transfering the coating film. With such a tool, however, winding of the used coating film transfer has to be done manually.

The present inventor has developed a method in which the used coating film transfer tape is wound up automatically (Japanese Utility Model application No. 68371/1991). This coating film transfer tool is, as shown in FIGS. 6–8, made up of a coating film transfer tape pay-out reel 4 and a used coating film transfer tape winding reel 5 mounted on two supporting shafts 2, 3 embedded in the case 1 to be freely rotatable, a coating film transfer head 6 is provided protrusively out of the case 1 and a cover plate 7 is fitted to close the side opening of the case 1.

The pay-out reel 4 is made up of a boss 9 of a drive gear wheel 8 and a pay-out cylinder 10 freely rotatable on the outer periphery of the boss 9 and the boss 9 and a rim 11 are connected by 4 spokes 12. The boss 9 is made up of an outer cylinder 14 outside of an inner cylinder 13 with a given gap therebetween, with a base end of the outer cylinder 14 in connection with the inner cylinder 13. The inner cylinder having a through hole and a supporting shaft 2 inserted rotatably therethrough. On the side wall of the outer cylinder 14, there are formed a pair of clutch arms 16, each having one clutch claw 15 at the forward end thereof and the clutch claw 15 is engaged disengageably through the elasticity of the clutch arms 16 with a plurality of claws 17 formed annularly in the inner periphery of the pay-out cylinder 10. Also amid the pair of spokes 12, there are formed a pair of arc-shaped ratchet arms 19 with stopper claws 18 formed at the tip thereof and the stopper claws 18 are engaged disengageably through the elasticity of the ratched arms 19 with a plurality of claws 20 formed annularly on the inside of the case 1 to thereby prevent free rotation of the pay-out reel 4 and winding reel 15.

Meanwhile, the winding reel 5 forms a tape guiding flange 22 on the base end of a winding cylinder 21 and also forming a driven gear wheel 23 to be in mesh with a drive gear wheel 8 on the back of the flange 22 and having its supporting shaft 3 set freely rotatable through the through hole in the winding cylinder 21. The number of teeth of the driven gear wheel 23 is approximately ½ that of the drive gear wheel 8.

The pay-out cylinder 10 has a coating film transfer tape 24 wound thereon, then one end of the coating film transfer tape 24 is paid out from the pay-out cylinder 10, it is then twisted by 90° by a guide pin 25 a little before the head 6 and led outward, thereafter it is led past the peak-shaped portion 26 of the head 6 into the case 1, the aforementioned twisting is restored until it reaches the guide pin 27 or it is further twisted by 90° before it is wound on the winding cylinder 21. In the amount of the coating film transfer tape 24 wound on the pay-out cylinder 10 is approximately twice as much as the diameter of the winding cylinder 21. By the way, the coating film transfer tape 24 is so wound that the coating film to be transferred is on the outside of the loop.

When the coating film transfer tool of the aforementioned construction is used as a tool for erasing characters or the like, a white corrective paint film is to be formed as the coating film transfer tape 24 over a layer of a release agent on one side of the substrate tape with a layer of the adhesive layer applied on the white corrective paint film. In order to erase characters or the like with this coating film transfer tape 24, the case 1 is to be moved in the direction perpendicular (the direction shown by the arrow "a" in FIG. 8) to the longitudinal direction of the coating film transfer tape 24 with the adhesive layer thereon being pressed against the characters or the like by means of the peak-shaped portion 26.

It is thereby possible to have the corrective paint layer on the coating film transfer tape 24 removed by the release agent layer and fixed by the adbesive layer on characters and the like by means of the peak-shaped portion 26. As the case 1 moves, the tension being applied to the coating film transfer tape 24 acts as a rotation torque to the pay-out cylinder 10, the pay-out cylinder 10 with its engagement with its claw 17 and with clutch claw 15 moves with the drive gear wheel B and a new coating film transfer tape 24 is paid out. The stopper claw 18 then goes out of engagement with the claw 20 because of the elasticity of the ratchet arm 19, the rotation of the drive gear wheel 8 being thus permitted. The drive gear wheel 8 rotates the winding cylinder 21 via the driven gear wheel 23 and the winding cylinder 21 winds the used coating film transfer tape 24 automatically. Thus, the corrective paint layer of the coating film transfer tape 24 is transferred on characters or the like for erasing thereof successively and the used coating film transfer tape 24 is automatically wound by the winding reel 5.

Meanwhile, the outer diameter of the coating film transfer tape 24 on the pay-out reel 4 decreases as erasing proceeds, this resulting in a lower feeding speed, while the outer diameter of the coating film transfer tape 24 on the winding reel 5 increases, this resulting in a higher winding speed. If this is allowed to continue, the coating film transfer tape 24 is bound to be broken due to the increasing tension, hence the feeding speed and the winding speed have to be synchronized. Hence, it is so arranged that, when the synchronism between the above two speeds is broken and the torque acting on the pay-out cylinder 10 is increased, the clutch claws 15 are disengaged from the claws 17 by the elasticity of the clutch arm 16 and the pay-out cylinder 10 is allowed to rotate in sliding contact with the outer cylinder 14 for restoration of synchronism between the feeding speed and the winding speed.

When the above-mentioned coating film transfer tool is used as a pasting tool, a coating film transfer tape 24 in which an adhesive layer is formed on one side of a substrate tape over a release agent layer is used and the adhesive layer alone is transferred to the surface of paper or the like in the same way as the above-mentioned erasing tool.

With the above-mentioned conventional coating film transfer tool, when the pay-out cylinder 10 rotates in sliding contact with the outer cylinder 14 to synchronize the pay-out speed of the coating film transfer tape 24 with the winding speed thereof, the "sliding rotation" is bound to be repetition of disengaging of the clutch claw 15 and the claw 17 and reengaging of the two, this resulting in unevenness of the running speed of the coating film transfer tape 24 and, moreover, the running speed unevenness is bound to be greater, as the tool is used longer with increasing difference between the feeding speed and the winding speed.

The present invention is aimed at improving the conventional coating film transfer tool for solving the above-mentioned problems.

DISCLOSURE OF THE INVENTION

In order to attain the above-mentioned object, the coating film transfer tool of the present invention comprises a pay-out reel for feeding a coating film transfer tape and a winding reel for recovering the used coating film transfer tape provided in the case to be freely rotatable, and a peak-shaped coating film transfer head provided protrusively at one end of the aforementioned case, the aforementioned pay-out reel is made by setting a pay-out cylinder on the outer periphery of the boss of the drive gear wheel via a friction member of elastomer to be freely rotatable, the winding reel has provided on the outer periphery of the winding cylinder a driven gear wheel which is engaged with the above-mentioned drive gear wheel and one end of the coating film transfer tape wound on the pay-out cylinder is paid out from the pay-out cylinder, turned back by the peak-shaped portion of the head and led to be wound by the winding cylinder.

As the above-mentioned friction member, an O-ring may preferably be used.

One end of the coating film transfer tape paid out from the pay-out cylinder may as well be twisted by 90° ahead of the head and restored after passing the peak-shaped portion of the head or may be further twisted by 90° before it is wound by the winding cylinder.

BRIEF DESCRIPTION OF THE DRAWINGS

FIGS. 4 and 5 are views showing the way in which the present invention is manipulated.

FIG. 6 is a partly-cut front view showing an example of a conventional coating film transfer tool.

OPTIMUM EMBODIMENTS PRACTICING THE INVENTION

The present invention will be described in detail below with reference to FIGS. 1–5.

Embodiment 1

Figure 1:
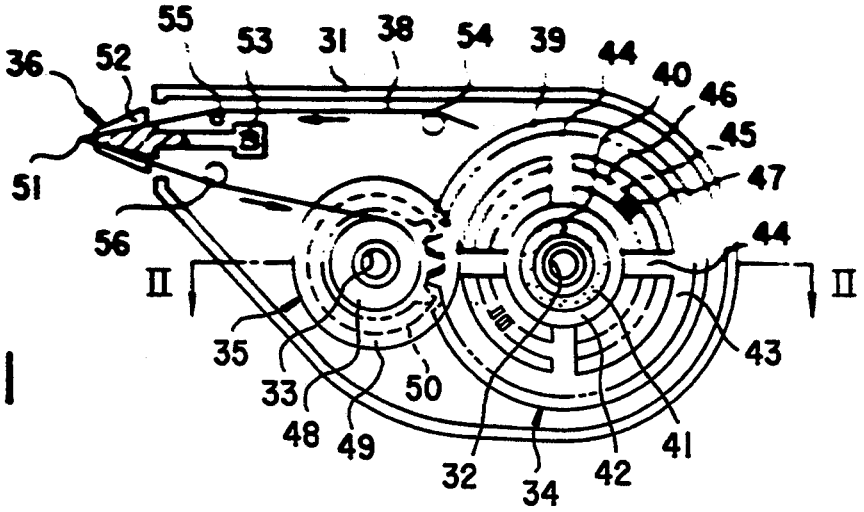
FIG. 1 is a partly-cut front view of the embodiment 1 of the present invention with the cover plate removed.
Figure 2:
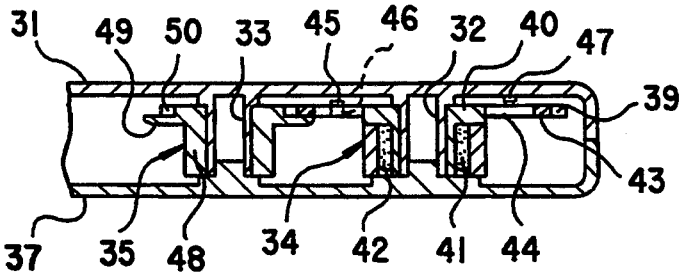
FIG. 2 is a sectional view taken along the line II—II of FIG. 1.

The coating film transfer tool of the present embodiment comprises, as shown in FIGS. 1 and 2, two supporting shafts 32, 33 embedded in a case 31 with a pay-out reel 34 for feeding a coating film transfer tape and a winding reel 35 for recovery of the used transfer tape supported free to rotate respectively, a coating film transfer head 36 protrusively provided at the forward end of the case 31 and a cover plate 37 provided to close the side opening of the case 31, and the pay-out reel 34 has wound thereon the coating film transfer tape 38.

The pay-out reel 34 comprises a pay-out cylinder 42 set on the outer periphery of a cylindrical boss 40 at the center of a drive gear wheel 39 via a friction member 41. The drive gear wheel 39 has its boss 40 and rim 43 connected by 4 spokes 44 and the through hole of the boss 40 has set therethrough a supporting shaft 32 to be freely rotatable. Between the pair of spokes 44, there are formed a pair of arc-shaped ratchet arms 46 having stopper claws 45 at its forward end, the stopper claws 45 disengageably engaged with a multiplicity of claws 47 by the elasticity of the ratchet arm 46 to prevent free rotation of the pay-out reel 34 and the winding reel 35.

The friction member 41 is for transmitting the torque acting on the pay-out cylinder 42 due to the tension of the coating film transfer tape 38 to the drive gear wheel 39 as friction torque. It comprises a cylindrical bush (the one shown in the figure), O-ring and the like made of an elastomer (e.g., nitrile rubber) and is disposed between the boss 40 and the pay-out cylinder 42 in somewhat compressed state.

The winding reel 35 forms a flange 49 for guiding the transfer tape on the outer periphery of the base end of the winding cylinder 48 and also forms a driven gear wheel 50 engaged with the drive gear wheel 39 on the back of a flange 49 with a supporting shaft 33 set through the through hole of the winding cylinder 48. The number of teeth of the driven gear wheel 50 is approximately ½ that of the drive gear wheel 39.

The head 36 comprises a peak-shaped portion 51, triangular in sectional shape and a guide flange 52 formed on each side thereof and its base is supported by a square pin 53 embedded inward of the case 31. It is, however, also possible to have the head 36 and the case 31 formed integrally.

The coating film transfer tape 38 is wound on the pay-out cylinder 42 and one end thereof is fed via the guide pins 54 and 55 embedded on the inside of the case 31, turned back by the peak-shaped portion 51 of the head 36 and then led past the guide pin 56 to be wound on the outer periphery of the winding cylinder 48. The transfer tape is then to be so set that the coating film comes to be on the outside of the loop. The number of laps of the coating film transfer tape 38 on the pay-out cylinder 42 before use may be such that the outer diameter of the tape wound thereon is approximately twice that of the winding cylinder 48. In other words, the ratio roughly corresponds to the ratio of the number of teeth of the drive gear wheel 39 to that of the driven gear wheel 50. If the ratio is higher, the winding speed of the coating film transfer tape 38 is too low in an early stage compared with the feeding speed, this resulting in slackening of the tape 38 as it is wound.

When the coating film transfer tool is used as an erasing tool for characters or the like, one comprising a plastic substrate film (approximately 25–38 μm) such as a polyester film or acetate film coated on one side with a layer of a release agent such as a vinyl chloride-vinyl acetate copolymer or low molecular polyethylene, a layer of a white corrective paint and thereupon a layer of pressure-sensitive adhesive such as a polyurethane, may be used as the coating film transfer tape 38.

In order to erase characters or the like with the above-mentioned coating film transfer tape 38, as shown by FIG. 4, the case 31 is moved in the longitudinal direction (direction of the arrow A in FIG. 4) of the coating film transfer tape 38, with the adhesive layer side of the coating film transfer tape 38 being pressed against characters or the like by the ,aid of the peak-shaped portion 51 of the head 36. The white corrective paint of the coating film transfer tape 38 is then transfered onto characters or the like as it is pressed by the peak-shaped portion 51 by means of the uppermost layer of adhesive and the underlying layer of the release agent. As the case 31 is moved, the tension being applied to the coating film transfer tape 38 acts as rotation torque on the pay-out cylinder 42 and the pay-out cylinder 42 rotates with the drive gear wheel 39 due to the friction force of the friction member 41, this resulting in further feeding of the coating film transfer tape 38. Then, the stopper claw 45 is disengaged from the claw 47 by the elasticity of the ratchet arm 46, this allowing rotation of the drive gear wheel 39. Also, the drive gear wheel 39 drives the winding cylinder 48 via the driven gear wheel 50 and she winding cylinder 48 winds automatically the substrate tape with the release agent layer alone remaining thereon. Thus, the corrective paint layer is transferred progressively onto characters or the like to erase them, the used coating film transfer tape 38 being recovered automatically.

However, as erasing goes on, the outer diameter of the coating film transfer tape 38 on the pay-out reel 34 becomes smaller, this resulting in decrease of the tape feeding speed, while, the outer diameter of the used tape on the winding reel 35 becomes larger, this resulting in increase of the used tape winding speed. Since this is bound to cause breaking of the coating film transfer tape 38 due to the increasing tension, it is necessary to synchronize the tape feeding speed with the used tape winding speed. It is, therefore, so arranged that, when the synchronism between the above-mentioned two speeds is broken, with the rotation torque acting on the pay-out cylinder 42 being larger, the increased torque exceeds the friction torque of the friction member 41 and this results in sliding of the tape on the pay-out cylinder 42 against the boss 40 of the drive gear wheel 39 to thereby synchronize the feeding speed with the winding speed. Hence, smooth running of the coating film transfer tape 38 is ensured.

When the coating film transfer tool of the above construction is used as a pasting tool, the substrate tape with a layer of adhesive alone is formed over a layer of release agent and the the adhesive layer alone is transferred to the paper surface or the like by the same process as described above.

Embodiment 2

Figure 3:
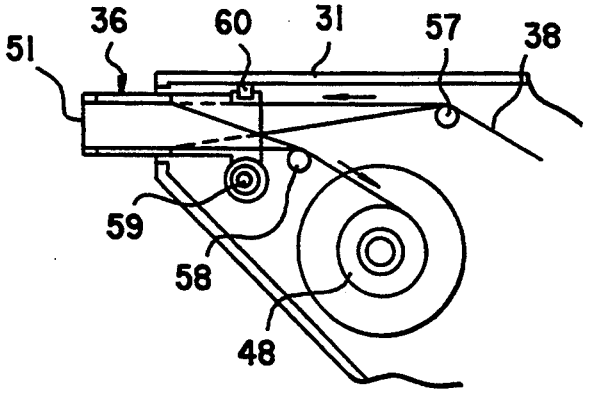
FIG. 3 is a partly detailed view of the embodiment 2 of the present invention.
Figure 7:
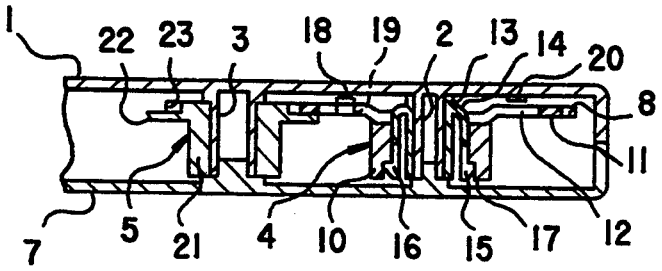
Fig.7 PRIOR ART
FIG. 7 is a sectional view taken along the line VII—VII of FIG. 6.
Figure 8:
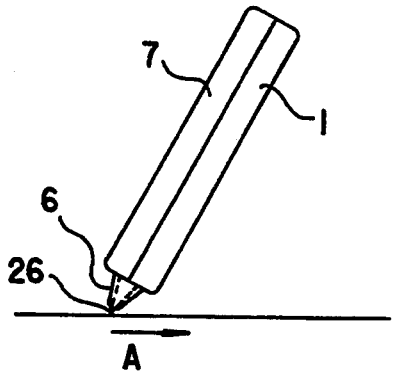
Fig.8 PRIOR ART
FIG. 8 is a view showing the way in which the conventional coating film transfer tool is manipulated.

In the coating film transfer tool of this embodiment as shown in FIG. 3, one end of the coating film transfer tape 38 fed from the pay-out cylinder 42 (not shown) is twisted by 90° by a guide pin 57 arranged inward of the head 36 to move outward, then led into the case 31 past the peak-shaped portion 51 of the head 36 and on its way to the guide pin 58 the twisting of the tape is restored or it is further twisted 90° before it is wound by the winding cylinder 48. The case 31 has embedded therein, besides the above-mentioned guide pins 57 and 58, a supporting pin 59 and has formed on its side wall a square projection 60, the supporting pin 59 being for supporting the base portion of the head 36 and the square projection 60 for prevention of rotation of the head 36. The other setup is the same as described above for Embodiment 1.

Since, with the coating film transfer tool of the invention, the coating film transfer tape 38 is twisted by 90° inward of the head 36, the operating direction is different from that of Embodiment 1, as shown in FIG. 5, the case 31 being moved in a direction perpendicular to the longitudinal direction (direction of the arrow B in FIG. 5) of the coating film transfer tape 38.

POSSIBILITY OF INDUSTRIAL UTILIZATION

As described above, the present invention consists in that the pay-out cylinder is set freely rotatable on the outer periphery of the boss of the drive gear wheel via the friction member made of an elastomer and the torque acting on the pay-out cylinder induced by the tension of the coating film transfer tape is transmitted to the drive gear wheel as the friction torque of the friction member, hence even when, as the result of continued use, the synchronism between the feeding speed and the winding speed of the coating film transfer tape has been broken, the synchronism is restored when the pay-out cylinder rotates in sliding contact with the boss of the drive gear wheel, this ensuring always in smooth running of the coating film transfer tape.

It is convenient to use an O-ring as the friction member, for it is commercially available.

An alternative of the coating film transfer tool in which the coating film transfer tape is twisted by 90° ahead of the head allows holding the case in a hand and moving it horizontally with the elbow on the desk top, hence it is easy to bring the head accurately and stably to the desired position. Thus, provision of tools different in the way of operation gives a wider scope of choice to users and an increased variety as merchandise.

What is claimed is:

1. A coating film transfer tool, comprising:

a case for the tool;

a pay-out reel for feeding a coating film transfer tape rotatably mounted in said case;

a winding reel for recovery of the used coating film transfer tape rotatably mounted in said case;

a head provided protrusively extending out of said case at one end of said case;

said pay-out reel including a pay-out cylinder and including a drive-gear wheel having a boss;

a friction member provided on an outer periphery of said boss of the drive gear wheel, said pay-out cylinder being in frictional contact with said friction member;

said winding reel including a winding cylinder and including a driven gear wheel which engages with said drive gear wheel said coating film transfer tape being wound on said pay-out cylinder, being fed from said pay-out cylinder, being turned around over said head, and being wound around said winding cylinder.

2. The coating film transfer tool according to claim 1, wherein said friction member is an O-ring made of an elastomer.

3. The coating film transfer tool according to claim 1, wherein the coating film transfer tape fed from the pay-out cylinder is arranged such that it is twisted by 90° before the head, and after the head, the twisting is restored before it is wound on the winding cylinder.

4. The coating film transfer tool according to claim 1, wherein said head is a peak-shaped head.

5. The coating film transfer tool according to claim 1, wherein said friction member is made of an elastomer.

6. The coating film transfer tool according to claim 1, wherein the coating film transfer tape fed from the payout cylinder is arranged such that it is twisted 90° before the head, and after passing the head, the tape is further twisted 90° before it is wound onto the winding cylinder.

* * * * *